US006926149B2

(12) United States Patent
Tippey

(10) Patent No.: US 6,926,149 B2
(45) Date of Patent: Aug. 9, 2005

(54) COMPRESSED PACKAGE HAVING AN OPENING MECHANISM AND AN EXPANSION MEMBER

(75) Inventor: Darold Dean Tippey, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/716,350

(22) Filed: Nov. 18, 2003

(65) Prior Publication Data

US 2005/0103667 A1 May 19, 2005

(51) Int. Cl.[7] ..... B65D 73/00; B65D 83/00; B65D 85/00; A61L 51/00

(52) U.S. Cl. ..... 206/494; 206/438; 206/440; 206/459.5; 221/64; 221/65

(58) Field of Search ..... 206/494, 438, 206/440, 775, 779, 524.8, 805, 459.5; 221/64, 221/65, 304, 307, 241, 244, 194–196; 604/358

(56) References Cited

U.S. PATENT DOCUMENTS

| | | | | |
|---|---|---|---|---|
| 1,846,949 A | | 2/1932 | Clark | |
| 3,145,840 A | | 8/1964 | Wright | |
| 3,197,062 A | | 7/1965 | Day et al. | |
| 3,632,010 A | | 1/1972 | Marty, Sr. | |
| 3,746,066 A | | 7/1973 | McIntyre | |
| 4,414,788 A | | 11/1983 | Berg | |
| 4,934,535 A | * | 6/1990 | Muckenfuhs et al. | 206/494 |
| 5,050,742 A | * | 9/1991 | Muckenfuhs | 206/494 |
| 5,219,421 A | | 6/1993 | Tipping | |
| 5,282,687 A | | 2/1994 | Yee | |
| 5,377,837 A | | 1/1995 | Roussel | |
| 5,379,897 A | | 1/1995 | Muckenfuhs et al. | |
| 5,464,285 A | | 11/1995 | Anderson | |
| 5,743,447 A | | 4/1998 | McDermott | |
| 5,934,470 A | * | 8/1999 | Bauer et al. | 206/494 |
| 5,987,833 A | | 11/1999 | Heffelfinger et al. | |
| 6,729,471 B2 | * | 5/2004 | O'Connor et al. | 206/494 |
| 2003/0115837 A1 | * | 6/2003 | Zimmer et al. | 53/436 |

FOREIGN PATENT DOCUMENTS

| | | |
|---|---|---|
| EP | 1 074 481 A1 | 2/2001 |
| EP | 1 092 651 A | 4/2001 |
| EP | 0 942 881 B1 | 10/2001 |
| EP | 0 780 325 B1 | 10/2002 |
| WO | WO 01/07336 A1 | 2/2001 |

* cited by examiner

*Primary Examiner*—Mickey Yu
*Assistant Examiner*—J. Gregory Pickett
(74) *Attorney, Agent, or Firm*—Thomas J. Connelly

(57) ABSTRACT

A package is disclosed having an enclosed compartment with a pair of oppositely aligned walls and a perimeter. An array of compressible articles is retained in the enclosed compartment in an initial orientation. The package also includes an opening mechanism capable of being activated to provide an opening into the enclosed compartment. The opening is of sufficient size to allow the articles to be individually removed. The package further includes an expansion member secured to the enclosed compartment and capable of expanding outward through the opening. The expansion member permits removal of the articles from the opened package while retaining the remaining articles in their initial orientation.

23 Claims, 5 Drawing Sheets

COMPRESSED PACKAGE HAVING AN OPENING MECHANISM AND AN EXPANSION MEMBER

BACKGROUND OF THE INVENTION

Today many manufacturers are using compress packaging to reduce the size and volume of their packages. A smaller package reduces distribution and shipping costs while providing the same number of products to the consumer. A smaller package also requires less shelf space at a retail store which means that additional packages can be stocked and displayed for sale in a similar size area as was used for the larger size packages. Compress packaging works especially well for absorbent articles, such as diapers, training pants, adult incontinent garments, feminine napkins, adult incontinent pads, wet wipes, facial tissue, as well as other products that normally contain air. Absorbent articles can be compressed to eliminate air within the product as well as to flatten or downsize the actual product. One trade off with a more densely compressed package is that it is usually harder to withdraw the first few articles from the opened package.

Various package designs have been tried to alleviate this problem but most have had only modest in-use success. For absorbent articles in particular, the articles are designed for various age groups. For example, diapers designed for infants and young children normally require a parent or caregiver to remove the article from the package while at the same time restraining the infant or child. This means that sometimes the parent or caregiver has only one hand available to remove a diaper from the package. As for older adults using incontinent pads and undergarments, many suffer from arthritis in their hands and/or poor eyesight and it may be difficult for them to extract a single article from a highly compressed package.

Now a package has been developed that utilizes a unique design that allows the package and articles retained therein to be compressed while providing an easy to use opening mechanism. The package also includes an expansion member which permits individual removal of the articles from the opened package while retaining the remaining articles in their initial orientation.

SUMMARY OF THE INVENTION

Briefly, this invention relates to a package having an enclosed compartment with a pair of oppositely aligned walls and a perimeter. An array of compressible articles is retained in the enclosed compartment in an initial orientation. Each of the articles has at least one planar surface aligned substantially parallel to at least one of the pair of oppositely aligned walls and is held in compression in a direction that is substantially perpendicular to the planar surface. The package also includes an opening mechanism capable of being activated to provide an opening into the enclosed compartment. The opening is of sufficient size to allow the articles to be individually removed. The package further includes an expansion member secured to the enclosed compartment and capable of expanding outward through the opening. The expansion member permits removal of the articles from the opened package while retaining the remaining articles in their initial orientation.

DETAILED DESCRIPTION

Figure 1:
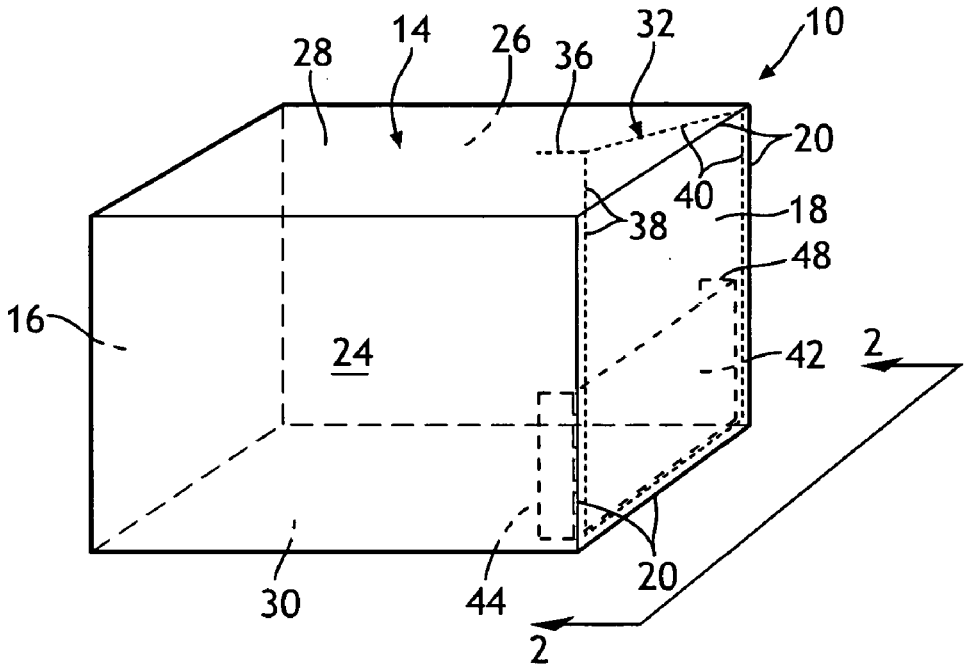
FIG. 1 is a perspective view of a package showing an opening mechanism and an expansion member.

Referring to FIGS. 1–6, a package 10 is shown which is adapted to retain an array of compressible articles 12. By "compressible" is meant that the articles 12 are capable of being compressed in one or more directions. By "compress" it is meant to press or squeeze together, to shorten or condense, to flatten laterally or lengthwise. For example, the volume of the package 10 may be reduced. The package 10 could be compressed by using vacuum or by other means known to those skilled in the art. The compressible articles 12 can be almost any kind of articles, including absorbent articles, for example, disposable absorbent articles. The compressible articles 12 can be infant diapers, training pants or adult incontinent garments including undergarments, briefs and pants. The compressible articles 12 can also be incontinent pads, feminine sanitary napkins, pantyliners, menstrual pants, wet wipes, facial tissue, paper towels, paper napkins, or any other absorbent article known to those skilled in the art. Furthermore, the compressible articles 12 can be non-absorbent articles that are capable of being compressed. Examples of non-absorbent articles include clothing, some foods, medicines, some sporting goods, etc. When the articles 12 are compressed, air located in and/or between adjacent articles can be squeezed, or drawn out by vacuum, to make a smaller, denser package. Such articles 12 are capable of expanding or enlarging once the compressive force is removed, such as when the package 10 is opened.

It should be noted that the package 10 is capable of holding and enclosing multiple articles 12 and the number, size and shape of such articles 12 can vary. Since the act of compressing a package and its contents will reduce the overall dimensions of the finished package 10, and maybe the articles 12 contained therein, it is envisioned that a compressed package can house up to several hundred articles. Typically, a compressed package can store from between 1 to about 1,000 articles. Desirably, a compressed package of disposable absorbent articles will contain from between 3 to about 150 articles. More desirably, a compressed package of disposable absorbent articles 12 will contain from between 6 to about 50 articles. Most desirably, a compressed package of disposable absorbent articles 12 will contain at least 12 articles.

The package 10 includes an enclosed compartment 14 having a pair of oppositely aligned walls 16 and 18 and a perimeter 20. Other structure forming the package 10 will be explained shortly. The perimeter 20 is measured about the outer periphery of the package 10. The package 10 can be constructed from various materials, including a flexible material such as paper or a thermoplastic material such as a thin plastic. Other materials from which the package 10 can be constructed include a flexible plastic material, a plastic film, a plastic laminate, a blend of two or more plastic materials, a blend of paper and a plastic material, a non-woven such as spunbond, or a cloth material such as cotton, nylon, rayon, polyester, etc. Other kinds of materials known to those skilled in the art can also be used. It is desirable that the package 10 be formed from a non-rigid, pliable material. However, one or more walls or surfaces of the package 10 can be semi-rigid in structure. By "semi-rigid" it is meant a material that may be stiff in at least one direction but can be easily bent or distorted in one or more directions. Examples of some semi-rigid materials include different grades of cardboard, paper board, a stiff plastic sheet, blended films, laminates, a thin wood veneer, etc. Desirably, the package 10 is formed from a flexible material that can itself be compressed after a plurality of compressible articles 12 are inserted therein. The flexible material should be dimensionally stable once the package 10 is compressed and sealed and can maintain its dimensions while subjected to pressure from within the package 10 until the package 10 is opened. Polypropylene or polyethylene film, as well as a laminate formed therefrom are flexible materials that are commercially available today. The plastic film can have almost any thickness but a thickness of less than about 5 millimeters (mm) is useful for most packages. A film material having a thickness of between about 1 mm to about 5 mm can be very cost effective, especially when large quantities of packages need to be manufactured. Flexible plastic bags and packages constructed from a thin sheet of material are very advantageous to use since they are compressible and do not have rigid corners.

Figure 3:
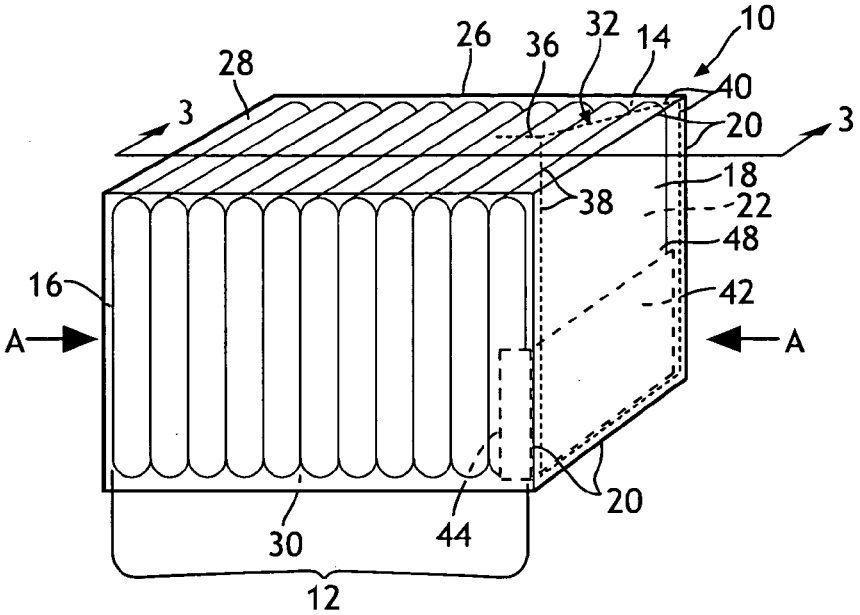
FIG. 3 is a perspective view of the package shown in FIG. 1, depicting an array of compressed absorbent articles retained therein.
Figure 4:
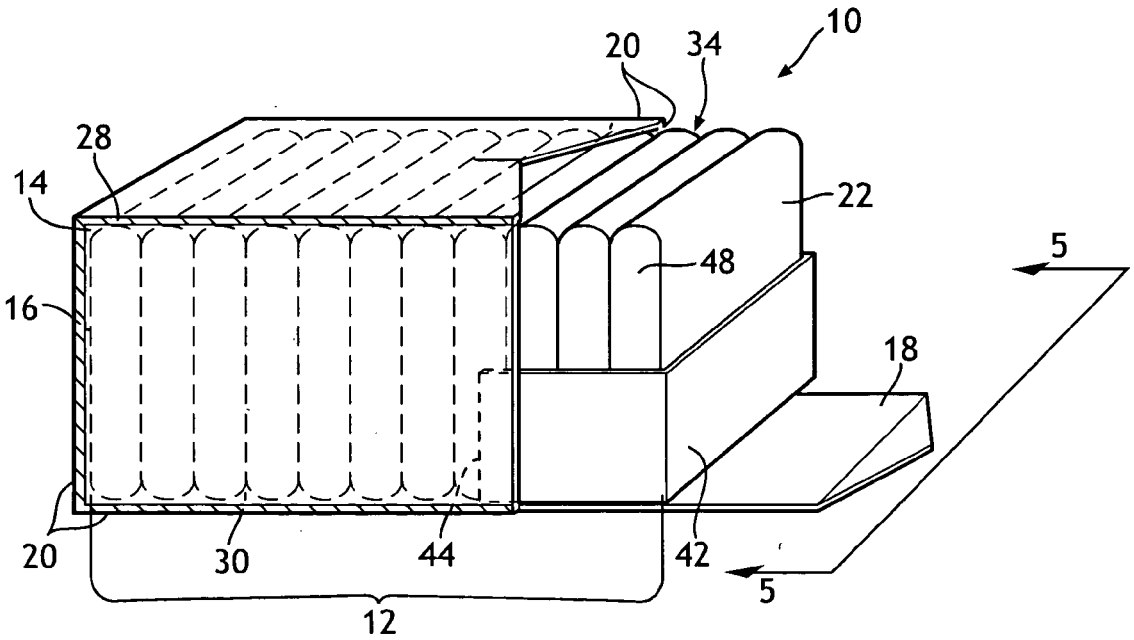
FIG. 4 is a perspective view of the package shown in FIG. 3 after the opening mechanism has been activated and the array of compressed articles have expanded causing the expansion member to stretch outward.
Figure 5:
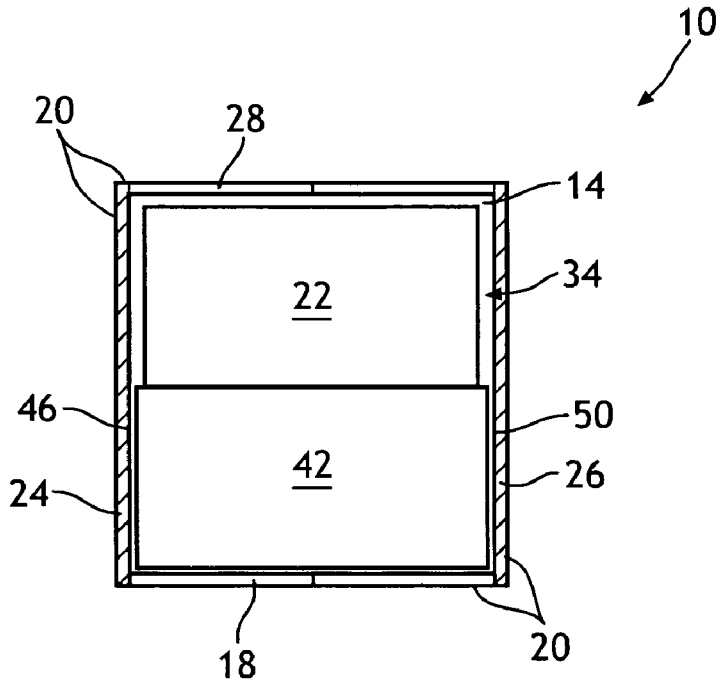
FIG. 5 is an end view of the open package shown in FIG. 4 taken along line 5—5.
Figure 6:
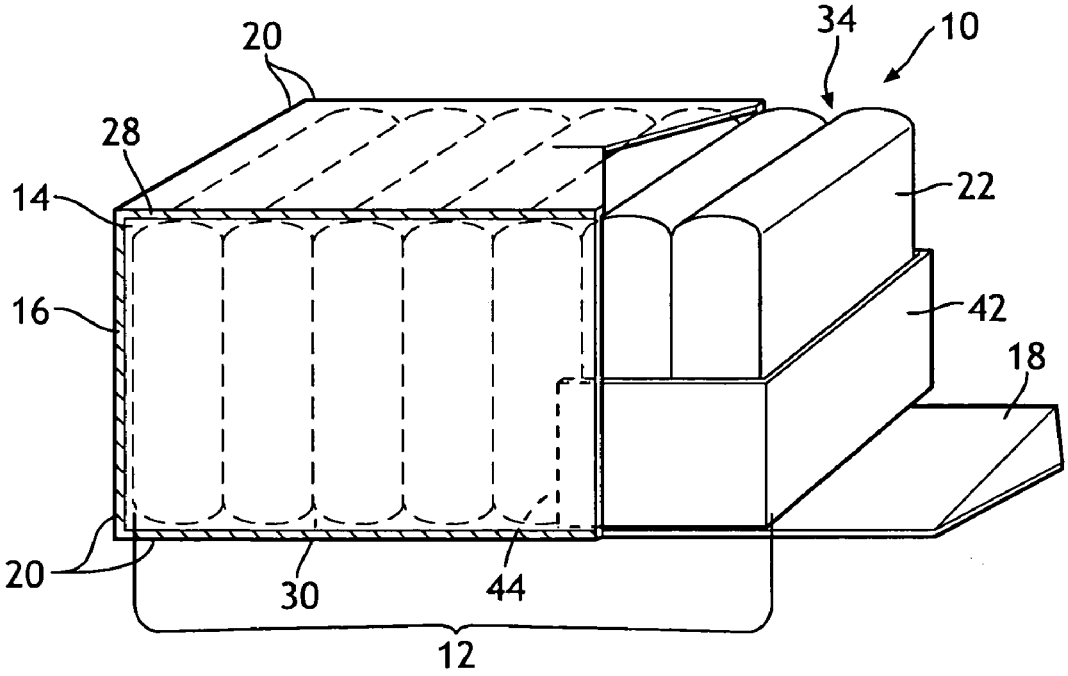
FIG. 6 is a perspective view of the open package shown in FIG. 4 after several of the articles have been removed and the remaining articles have had an opportunity to further expand.

Referring to FIGS. 3–6, the compressible articles 12 are retained in the enclosed compartment 14 in an initial orientation. Each of the articles has at least one planar surface 22 aligned substantially parallel to at least one of the pair of oppositely aligned walls 16 and 18. By "planar" is meant a relatively flat surface having two dimensions, for example, a length and a width. The array of compressible articles 12 are held or retained within the enclosed compartment 14 in a compressed condition and in a direction that is substantially perpendicular to the planar surface 22. In FIG. 3, the direction of compression is indicated by the two arrows, labeled "A".

Figure 2:
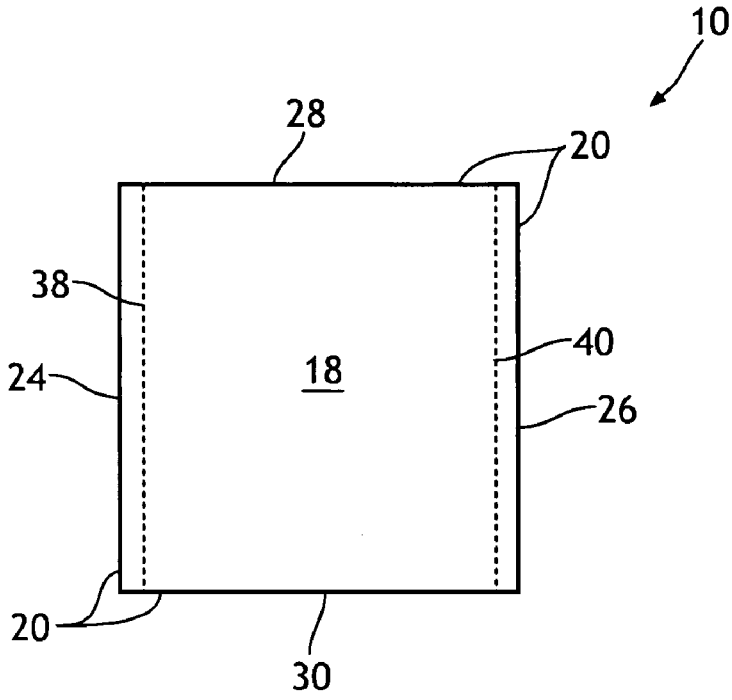
FIG. 2 is an end view of the package shown in FIG. 1 taken along line 2—2.

Referring to FIGS. 1 and 2, a six sided flexible and compressible package 10 is shown having a front wall 24 and a back wall 26 joined to one another by the pair of side walls 16 and 18. The package 10 also has a top wall 28 and a bottom wall 30 joined to the other walls 16, 18, 24 and 26 to form the enclosed compartment 14. The perimeter 20 of the package 10 extends from the front wall 24 around the top wall 28, the back wall 26 and the bottom wall 30. Another way of measuring the perimeter 20 is from the front wall 24 around the side wall 16, the back wall 26 and the other side wall 18. The terms: "top, bottom, front, back and sides" are used to describe the orientation of the package 10, as shown in FIG. 1. However, it should be noted that the package 10 can be rotated or reoriented such that what was the top wall 28 can become a side wall, or a back wall, etc.

Referring again to FIGS. 1–6, the package 10 also includes an opening mechanism 32 capable of being activated to provide an opening 34, see FIGS. 4–6, into the enclosed compartment 14. The opening mechanism 32 can be formed in a variety of ways and from various materials, some of which will be described shortly. The opening 34 should be of sufficient size to allow the compressed articles 12 to be easily removed from the opened package 10. The opening 34 should also be aligned adjacent to one of the planar surfaces 22 of the articles 12 to allow for easy removal thereof. The compressed articles 12 can be individually removed through the opening 34 or they can be removed as a group. The size of a particular group will depend upon the size and shape of the articles themselves. For example, in a package containing adult incontinence undergarments, a group can consist of from 2 to about 6 articles. However, the size of a group of articles can be greater than 6, if desired.

Referring again to FIGS. 1, 2 and 3, the opening mechanism 32 is depicted as a frangible line 36, such as a tear line, that is formed in the top wall 28. The frangible line 36 can be broken or torn open by depressing or applying a force to the frangible line itself or by pulling or applying a force to the material located on either side of the frangible line 36. The single frangible line 36 forks into two separate frangible lines 38 and 40 that angle outward toward the front and back walls, 24 and 26 respectively, before extending downward along the edges of the side wall 18, see FIG. 2. The frangible lines 38 and 40 can be located adjacent to the edges of the side wall 18 or be spaced inward from the edges a predetermined distance.

It should be noted that the opening mechanism 32 can consist of a single frangible line or two or more frangible lines. When two or more frangible lines are used, they can be aligned parallel or non-parallel to one another. Furthermore, when two or more frangible lines are utilized, they can intersect one another at one or more locations. The opening mechanism 32 can be formed in one of the walls 16, 18, 24, 26, 28 or 30 that forms the package 10 or be formed in two or more of the walls. The opening mechanism 32 can also be formed in two or more adjacent walls. In FIGS. 1–3, the opening mechanism 32 is shown being formed in the top wall 28 as well as the adjacent side wall 18. It is also desirable to form the opening mechanism 32 in one of the pair of oppositely aligned side walls 16 or 18 to facilitate removal of the compressed articles 12 from the package 10.

The opening mechanism 32 has been described above as being one or more frangible tear lines 36, 38 and 40. These frangible lines 36, 38 and 40 can be continuous lines or intermittent lines with areas of weakness formed therein. There are several ways of forming a frangible tear line. One way is to form a perforated line. Another way is to form a score line or a line that has been necked down or reduced in thickness. Although the opening mechanism 32 has been described as a "line," it could also be formed as a zone or area of weakness. One or more zones or areas of weakness can be used. The opening mechanism 32 can also be in the form or configuration of a mechanical connection such as a zip lock strip, a zipper or a Velcro® attachment. VELCRO® is a registered trademark of the Velcro Industries B. V. having an office at 1 Post Office Sq. Boston, Mass. 02109. Furthermore, the opening mechanism 32 can also consist of two materials that are joined together by an adhesive in such a manner that they can be easily separated, such as by an adhesive with a low peel strength value. These and other types of opening mechanisms known to those skilled in the art can be employed.

For disposable absorbent articles, such as an adult incontinent undergarment, the package 10 is normally formed from a thin plastic film. One or more frangible tear lines formed in this thin plastic film works well because it is easy to manufacture and forms a clean break when the frangible line is broken. This is an important aesthetic feature that many consumers like. It is also possible to color or tint the area adjacent to the opening mechanism 32 to make it more visible relative to the color or graphics on the package 10. A visually distinctive opening mechanism 32 can catch the attention of the consumer's eyes and aid them in properly opening the package 10.

Still referring again to FIGS. 1 and 3–6, the package 10 further includes an expansion member 42. The expansion member 42 is secured to the enclosed compartment 14 and is capable of expanding outward through the opening 34 once the opening mechanism 32 is activated. The expansion member 42 permits the compressed articles 12 to expand so that they are easier to remove from the open package 10. In addition, the expansion member 42 will retain the remaining articles 12 in their initial orientation. In short, the expansion member 42 will prevent the remaining articles 12 from falling over one another after a certain quantity of the articles 12 have been removed from the package 10. As depicted, the expansion member 42 is a strip or piece of material that is capable of being stretched. Desirably, the expansion member 42 will also be capable of retracting back towards or to its original length and size once a sufficient number of articles 12 have been removed from the package 10.

The expansion member 42 can be formed from almost any stretchable and/or retractable material. However, certain stretchable and/or retractable materials will function better than others. The expansion member 42 should be formed from a material that can stretch in at least one direction. Desirably, the expansion member 42 should be formed from a material that can stretch in two or more directions. For example, one may wish to use an expansion material that can stretch and retract in the x, y and z directions. The expansion member 42 should be formed from a material that can stretch from about 50% to about 1,000% of its initial length or size. Desirably, the expansion member 42 should be formed from a material that can stretch from about 75% to about 500% of its initial length or size. More desirably, the expansion member 42 should be formed from a material that can stretch from about 100% to about 400% of its initial length or size. Most desirably, the expansion member 42 should be formed from a material that can stretch from about 150% to about 300% of its initial length or size.

Various materials from which the expansion member 42 can be constructed include natural or synthetic elastic materials, natural or synthetic rubber, synthetic latex, a stretch bonded laminate, a neck bonded laminate, spandex, Lycra®, an elastomeric material such as an elastomeric film or laminate, or other materials capable of being stretched and/or retracted that are known to those skilled in the art. LYCRA® is a registered trademark of E. I. Du Pont De Nemours & Company having an office at 1007 Market Street Wilmington, Del. 19898.

Still referring again to FIGS. 1 and 3–6, the expansion member 42 is depicted as a rectangular piece of stretchable material having a U-shaped profile. It should be noted that the expansion member 42 can be cut or formed into any desired geometrical shape or configuration that one desires. The U-shaped profile will increase in size as the opening mechanism 32 is activated and the compressed articles 12 expand and move outward through the opening 34 and away from the enclosed compartment 14. This feature is clearly depicted between the two embodiments shown in FIGS. 3 and 4. As some of the articles 12 are removed from the opened package 10, the remaining compressed articles 12 will be able to expand even more, see FIG. 6. The expansion member 42 allows for the compressed articles to additionally expand after some of the articles 12 have been removed from the opened package 10. This feature is important for it facilitates easy removal of subsequent articles 12 from the opened package 10. Once a sufficient number of articles 12 have been removed from the opened package 10, the expansion member 42 will retract back towards its original length and size. By having the ability to retract back towards it original length, the expansion member 42 is able to maintain a force on the remaining articles 12 to keep them in their initial orientation. This will assist in holding the remaining articles 12 in an essentially upright position to facilitate their removal from the opened package 10.

Referring to FIGS. 1 and 3–6, the expansion member 42 has a first end 44, see FIG. 3, secured to an inner surface 46 of the front wall 24 and a second end 48 secured to the inner surface 50 of the back wall 26. The form of attachment or method of securing the expansion member 42 to the enclosed compartment 14 can be by an ultrasonic bond, by an adhesive, by a pressure bond, by a heat bond, by a heat and pressure bond, by a mechanical fastener, etc. Desirably, the expansion member 42 can be attached to the inside surfaces of the package 10 as the package 10 is being formed. Because the expansion member 42 needs to be capable of stretching and retracting more than the material from which the package 10 has been constructed, the expansion member 42 should be formed from a different material than was used to construct at least the front and back walls, 24 and 26 respectively, of the package 10. For example, the package 10 can be formed from a flexible plastic film having relatively little stretch capability while the expansion member 42 is formed from a stretchable elastomeric material.

Referring now to FIGS. 7–10, an alternative package 10' is shown having a different opening mechanism and an expansion member that wraps under a portion of the outermost articles. For ease of understanding, like numerals will be used in FIGS. 7–10 to denote identical structure as was present in FIGS. 1–6. The package 10' includes an array of compressible articles 12 each having at least one planar surface 22, not shown but similar to that shown in FIG. 3. The articles 12 are contained in an enclosed compartment 14. The package 10' has two oppositely aligned walls 16 and 18 and a perimeter 20. The package 10' also has a front wall 24, a back wall 26, a top wall 28 and a bottom wall 30.

Figure 7:
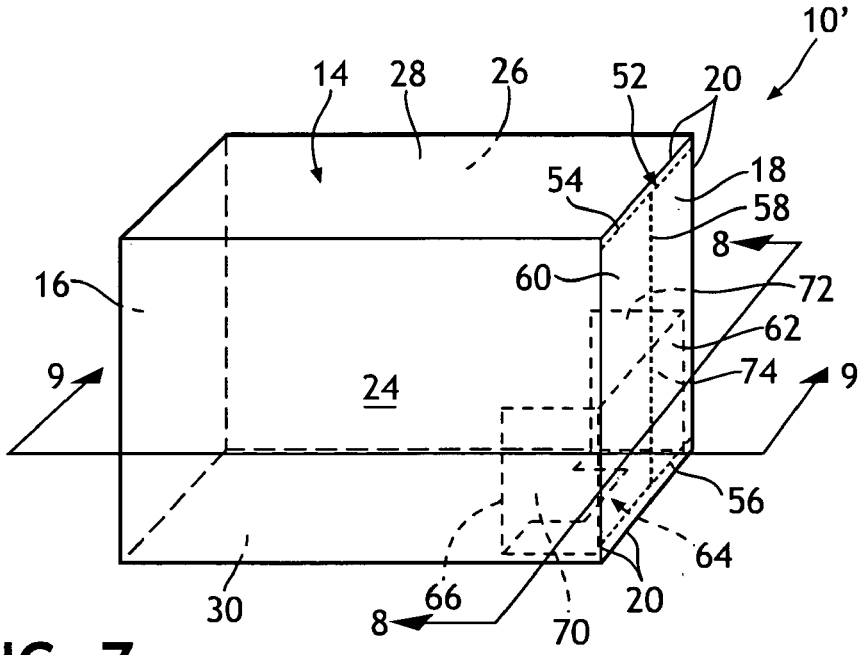
FIG. 7 is a perspective view of an alternative package design, without showing the retained articles, and having a different opening mechanism from that shown in FIGS. 1–6 and having an expansion member that wraps under a portion of the outermost articles.
Figure 8:
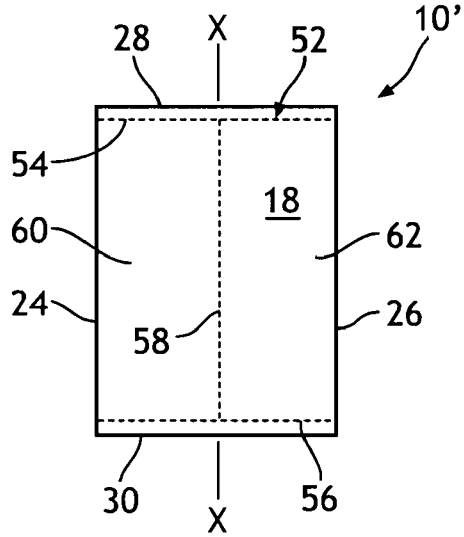
FIG. 8 is an end view of the package shown in FIG. 7 taken along line 8—8.

Referring to FIGS. 7 and 8, the package 10' differs from that shown in FIGS. 1–6 in that it has an opening mechanism 52 that includes three frangible tear lines 54, 56 and 58 all arranged in the side wall 18. The three frangible tear lines 54, 56 and 58 form an I-beam shape. The first frangible tear line 54 is positioned adjacent to the top wall 28, the second frangible tear line 56 is positioned adjacent to the bottom wall 30, and the third frangible line 58 is positioned perpendicular to the first and second frangible tear lines 54 and 56. The third frangible tear line 58 is also aligned with the vertical centerline x—x of the side wall 18 although it does not need to be. As shown, the third frangible tear line 58 vertically divides the side wall 18 into two equal flaps 60 and 62. Unlike the opening mechanism 32 shown in FIGS. 1–6, the opening mechanism 52 does not extend into the top wall 28. However, the opening mechanism 52 is aligned adjacent to one of the planar surfaces 22 of the compressed articles 12, similar to FIG. 3. When the opening mechanism 52 is activated, an opening will occur in only the side wall 18. Once the frangible tear lines 54, 56 and 58 are broken or torn, the side wall 18 will be divided into two flaps 60 and 62, see FIG. 8. These two flaps 60 and 62 can pivot or rotate outward, see FIG. 10, to provide a sufficient size opening to allow the compressed articles 12 to expand outward while being partially constrained by an expansion member 64.

Figure 9:
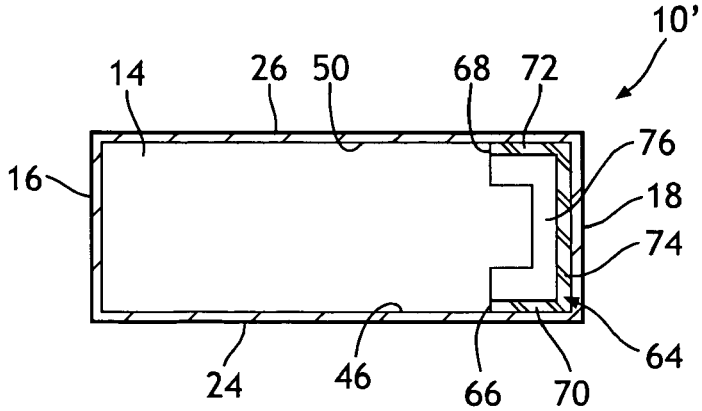
FIG. 9 is a cross-sectional view of the package shown in FIG. 7 taken along line 9—9 depicting the shape of the expansion member within the closed package.
Figure 10:
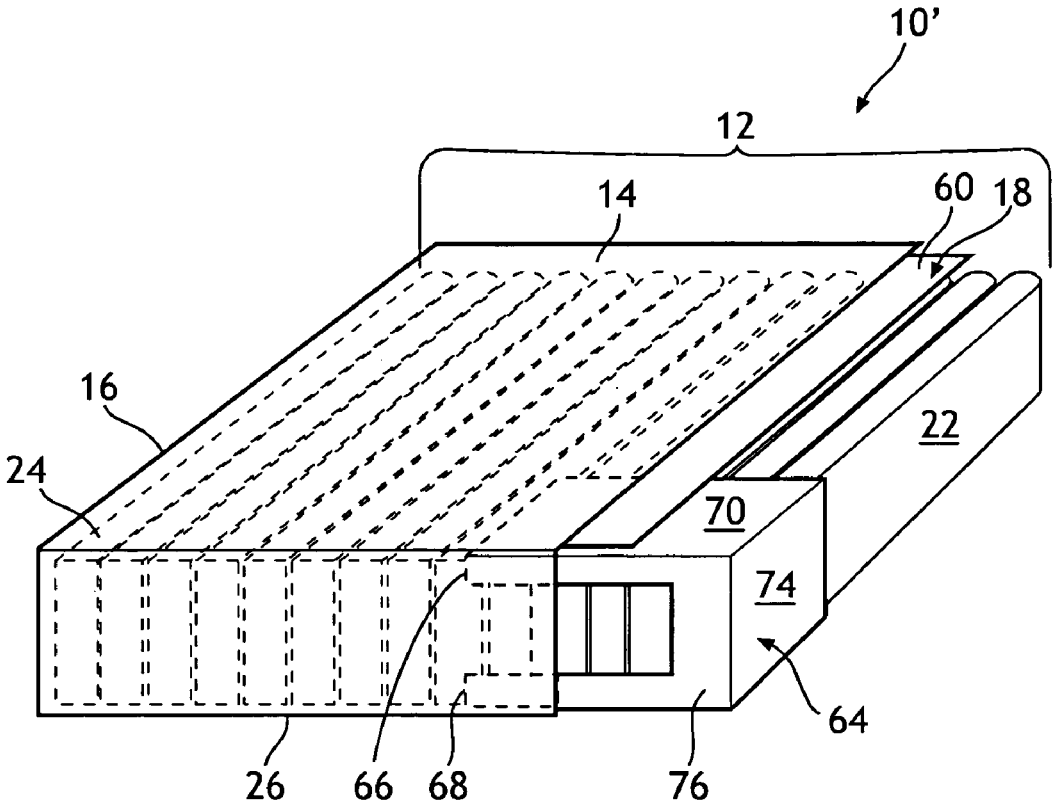
FIG. 10 is a perspective view of a package containing a plurality of compressible articles after the opening mechanism has been activated and the compressed articles have expanded thereby causing the expansion member to stretch outward while still wrapping under a portion of the bottom surface of the outermost articles.

Referring to FIGS. 7, 9 and 10, the expansion member 64 contains a unique configuration that allows it to contact from one to three sides of the outermost retained compressed article 12 as well as a portion of the bottom surface of the article 12. The expansion member 64 has a first end 66 secured to the inner surface 46 of the front wall 24 and a second end 68 secured to the inner surface 50 of the back wall 26. The form of attachment or method of securing the expansion member 64 to the enclosed compartment 14 can be the same as was explained above with reference to the expansion member 42. Desirably, the expansion member 64 can be attached to the inside surfaces of the package 10' as the package 10' is being formed. Because the expansion member 64 needs to be capable of stretching and retracting more than the material from which the package 10' has been constructed, the expansion member 64 should be formed from a different material than was used to construct at least the front and back walls, 24 and 26 respectively, of the package 10'. For example, the package 10' can be formed from a flexible plastic film having relatively little stretch capability while the expansion member 64 is formed from a stretchable elastomeric material.

Still referring to FIGS. 7, 9 and 10, the expansion member 64 also has a U-shaped profile consisting of a pair of side walls 70 and 72 joined to an end wall 74. In addition, the expansion member 64 has a bottom wall 76 connected to the walls 70, 72 and 74, see FIGS. 9 and 10. The bottom wall 76 also has a C-shaped configuration, although other geometrical shapes can be used. A portion of the bottom wall 76 can optionally be secured to the bottom wall 30 of the package 10', if needed. The bottom wall 76 is designed to contact the lower or bottom surface of the outermost compressed articles 12 and prevent the articles from falling or sliding downward after the package 10' has been opened. The C-shaped configuration also functions to provide a window through which the consumer of the package 10' can visually see the lower surfaces of the articles 12 that have exited the opening of the package 10'. This feature may be beneficial to the consumer for certain types of articles.

The expansion member 64 is able to expand and stretch outward once the opening mechanism 52 is activated. In so doing, the expansion member 64 will surround at least a portion of said bottom surface of the outermost articles 12 as well as up to three sides of the outermost article 12. The number of sides of the article that will be in contact with the expansion member 64 will depend on the size, shape and configuration of the articles themselves as well as the relationship of the articles to the outermost article. In FIG. 10, one can clearly see that the expansion member 64 will firmly support the articles 12 and prevent them from falling out of the opened package 10' even when the package 10' is rotated onto its back wall 26.

As was explained earlier in relation to the expansion member 42, the expansion member 64 allows for the compressed articles to additionally expand after some of the articles 12 have been removed from the opened package 10'. This feature is important for it facilitates easy removal of subsequent articles 12 from the opened package 10'. Once a sufficient number of articles 12 have been removed from the opened package 10', the expansion member 64 will retract back towards its original length and size. By having the ability to retract back towards it original length, the expansion member 64 is able to maintain a force on the remaining articles 12 to keep them in their initial orientation. This will assist in holding the remaining articles 12 in an essentially upright position to facilitate their removal from the opened package 10'.

Figure 11:
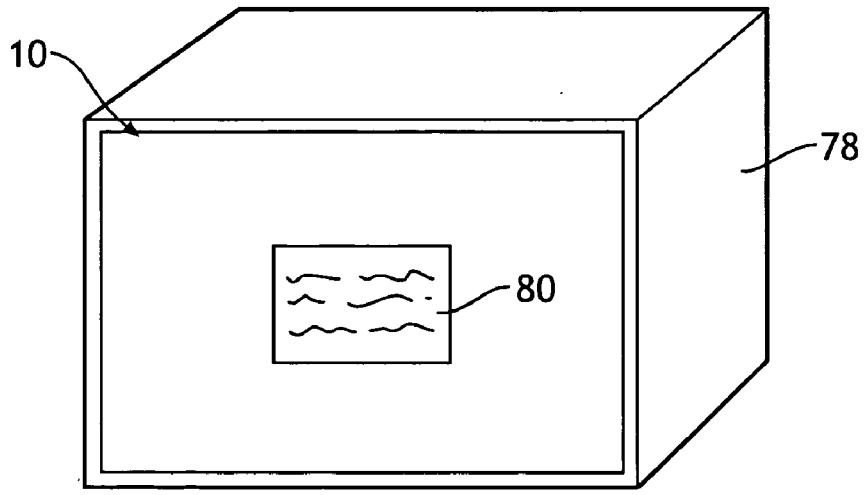
FIG. 11 is a perspective view of a package enclosed by a clear removable wrapper and having instructions for activating the opening mechanism either printed on the package or displaced on a card inserted between the package and the wrapper.

Referring now to FIG. 11, a package 10 is shown enclosed by a clear removable wrapper 78. Even though the package is designated 10, it could also be the package denoted 10'. The clear wrapper 78 can be formed from a thin, pliable material that can be visually seen through. Examples of such materials include clear polyethylene, clear polypropylene, cellophane, or any other commercially available material known to those skilled in the art. To assist the ultimate consumer in understanding how to properly activate the opening mechanism 32 or 52, instructions 80 can be included. The instructions 80 can be the form of written text, graphics, icons, etc. or a combination thereof. The instructions 80 can be either printed on an exterior surface of the package 10 or be displayed on a card inserted between the package 10 and the removable wrapper 78. The instructions 80 could also be printed on a sticker that is adhesively attached to the package 10 or the wrapper 78. In addition, the instructions 80 could also be printed on an interior or exterior surface of the wrapper 78. The instructions 80 can also inform the ultimate consumer on how to easily remove one or more articles 12 sequentially or simultaneously from the opened package 10. The instructions 80 could also provide information to the consumer on how to properly dispose of used or soiled articles.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

I claim:

1. A package comprising:

a) an enclosed compartment having a pair of oppositely aligned walls and a perimeter;

b) an array of compressible articles retained in said enclosed compartment in an initial orientation, said articles having at least one planar surface aligned substantially parallel to at least one of said pair of oppositely aligned walls and being held in compression in a direction that is substantially perpendicular to said planar surface;

c) an opening mechanism capable of being activated to provide an opening into said enclosed compartment, said opening being of sufficient size to allow said articles to be individually removed;

d) an expansion member secured to said enclosed compartment and capable of expanding outward through said opening, said expansion member permitting removal of said articles from said opened package while retaining said remaining articles in said initial orientation;

e) a removable wrapper enclosing said package; and f) instructions placed between said package and said wrapper for informing a consumer on how to activate said opening mechanism to facilitate removal of said articles from said package.

2. The package of claim 1 wherein said opening mechanism includes at least one frangible line.

3. The package of claim 1 wherein said opening mechanism includes at least two intersecting frangible lines.

4. The package of claim 1 wherein said opening mechanism is formed in one of said pair of oppositely aligned walls.

5. The package of claim 1 wherein said opening is aligned adjacent to one of said planar surfaces of said articles.

6. The package of claim 1 having a front wall and a back wall and said expansion member is secured to an inner surface of said front and back walls.

7. The package of claim 6 wherein said expansion member is formed from a material that is different from the material that forms said front and back walls.

8. The package of claim 1 wherein said expansion member is formed from a material that can stretch and retract.

9. The package of claim 8 wherein said expansion member is capable of stretching in more than one direction.

10. A package comprising:

a) an enclosed compartment having a pair of oppositely aligned walls and a perimeter;

b) an array of compressible articles retained in said enclosed compartment in an initial orientation, said articles having at least one planar surface aligned substantially parallel to at least one of said pair of oppositely aligned walls and being held in compression in a direction that is substantially perpendicular to said planar surface;

c) an opening mechanism capable of being activated to provide an opening into said enclosed compartment, said opening being of sufficient size to allow said articles to be individually removed;

d) an expansion member secured to an inner surface of said enclosed compartment and capable of expanding outward through said opening, said expansion member permitting removal of said articles from said opened package while retaining said remaining articles in said initial orientation;

e) a removable wrapper enclosing said package; and f) instructions placed between said package and said wrapper for informing a consumer on how to activate said opening mechanism to facilitate removal of said articles from said package.

11. The package of claim 10 wherein said opening mechanism is formed in two adjacent walls.

12. The package of claim 10 wherein said expansion member is formed from a stretchable material.

13. The package of claim 12 wherein said expansion member can stretch from between about 50% to about 1,000%.

14. The package of claim 13 wherein said expansion member can stretch from between about 75% to about 500%.

15. The package of claim 10 wherein each of said articles has a bottom surface and said expansion member surrounds at least a portion of said bottom surface once said articles have moved through said opening.

16. A package comprising:

a) a front wall and a back wall joined to one another by a pair of side walls, and a top wall and a bottom wall joined to said other walls to form an enclosed compartment having a perimeter;

b) an array of compressible articles housed in said enclosed compartment in an initial orientation, said articles having at least one planar surface aligned parallel to at least one of said pair of side walls and said articles being held in compression in a direction that is substantially perpendicular to said planar surface;

c) an opening mechanism capable of being activated to provide an opening into said enclosed compartment, said opening being of sufficient size to allow said articles to be individually removed; and d) an expansion member secured to an inner surface of said enclosed compartment and capable of expanding outward through said opening, said expansion member permitting removal of said articles from said opened package while retaining said remaining articles in said initial orientation;

e) a removable wrapper enclosing said package; and f) instructions placed between said package and said wrapper for informing a consumer on how to activate said opening mechanism to facilitate removal of said articles from said package.

17. The package of claim 16 wherein said array of compressible articles includes at least six articles.

18. The package of claim 16 wherein said walls forming said package are formed from a flexible material and said expansion member is formed from a stretchable material.

19. The package of claim 16 wherein said expansion member is formed from synthetic rubber.

20. The package of claim 16 wherein said expansion member is formed from synthetic latex.

21. The package of claim 1 wherein said wrapper is clear.

22. The package of claim 10 wherein said wrapper is clear.

23. The package of claim 16 wherein said wrapper is clear.

* * * * *